US008353680B2

(12) United States Patent
Schaefer et al.

(10) Patent No.: US 8,353,680 B2
(45) Date of Patent: Jan. 15, 2013

(54) AIR CONDITIONING COMPRESSOR

(75) Inventors: Tilo Schaefer, Daubach (DE); Thomas Di Vito, Wehrheim (DE)

(73) Assignee: ixetic MAC GmbH, Bad Homburg v.d.H (DE)

( * ) Notice: Subject to any disclaimer, the term of this patent is extended or adjusted under 35 U.S.C. 154(b) by 479 days.

(21) Appl. No.: 12/450,490

(22) PCT Filed: Mar. 7, 2008

(86) PCT No.: PCT/DE2008/000414

§ 371 (c)(1),
(2), (4) Date: Mar. 3, 2010

(87) PCT Pub. No.: WO2008/119319

PCT Pub. Date: Oct. 9, 2008

(65) Prior Publication Data

US 2010/0150744 A1 Jun. 17, 2010

(30) Foreign Application Priority Data

Mar. 29, 2007 (DE) ..... 10 2007 015 039

(51) Int. Cl.
*F04B 1/26* (2006.01)
*F04B 1/12* (2006.01)
*F04B 27/08* (2006.01)

(52) U.S. Cl. ..... 417/222.2; 417/269; 92/12.2

(58) Field of Classification Search ..... 417/222.1, 417/222.2, 269, 270, 271, 272; 92/12.2; 91/499

See application file for complete search history.

(56) References Cited

U.S. PATENT DOCUMENTS

| | | | | |
|---|---|---|---|---|
| 4,543,043 | A | 9/1985 | Roberts | |
| 4,737,079 | A * | 4/1988 | Kurosawa et al. | 417/222.2 |
| 5,336,056 | A * | 8/1994 | Kimura et al. | 417/222.1 |
| 5,897,298 | A * | 4/1999 | Umemura | 417/222.2 |
| 5,980,216 | A * | 11/1999 | Tokumasu | 417/222.2 |
| 6,244,159 | B1 | 6/2001 | Kimura et al. | |
| 6,564,695 | B2 * | 5/2003 | Herder et al. | 92/12.2 |
| 2001/0028851 | A1 * | 10/2001 | Ota et al. | 417/269 |
| 2002/0178906 | A1 | 12/2002 | Herder et al. | |
| 2003/0026708 | A1 | 2/2003 | Ota et al. | |
| 2003/0044290 | A1 * | 3/2003 | Yokomachi et al. | 417/222.2 |
| 2005/0186087 | A1 * | 8/2005 | Koide et al. | 417/269 |
| 2006/0204369 | A1 * | 9/2006 | Sugino | 417/222.1 |

FOREIGN PATENT DOCUMENTS

| | | |
|---|---|---|
| DE | 42 11 695 A1 | 10/1992 |
| EP | 0 953 765 A2 | 11/1999 |
| EP | 1 281 867 A2 | 2/2003 |
| EP | 1 701 036 A1 | 9/2006 |

* cited by examiner

*Primary Examiner* — Peter J Bertheaud
(74) *Attorney, Agent, or Firm* — Davidson, Davidson & Kappel, LLC

(57) ABSTRACT

A stroke-adjustable air conditioning compressor, in particular for motor vehicles, including a drive mechanism for pistons that move back and forth, the pistons being driven by an adjusting plate, such as a pivoting plate, pivoting ring or swash plate at an adjustable pivoting angle. The position of the pivoting angle is influenced inter alia by compressive forces, inertial forces and elastic forces that are active in the drive mechanism.

12 Claims, 4 Drawing Sheets

AIR CONDITIONING COMPRESSOR

The present invention relates to a variable-displacement air-conditioning compressor, in particular for motor vehicles, having a drive unit for pistons that reciprocate within cylinder bores, the pistons being driven via an adjusting plate, such as a swivel plate, swivel ring or swash plate, having an adjustable pivoting angle, and the position of the pivoting angle being influenced, inter alia, by pressure forces, inertia forces and spring forces that act in the drive unit.

BACKGROUND

Air-conditioning compressors of this kind are generally known. In this context, the problem arises that, in the switched-off air-conditioning operation, the air-conditioning compressors are prone to vibrations of the pivoting mechanism about its neutral position in response to a rotating combustion engine. Air-conditioning compressors are also known that do not start from a stable angular pivot position when there is a demand for cooling power, thus when the air-conditioning system is turned on, thereby leading to vibrations during start-up or to start-up delays.

SUMMARY OF THE INVENTION

It is, therefore, an object of the present invention to devise an air-conditioning compressor that will overcome these problems.

The present invention provides a variable-displacement air-conditioning compressor, in particular for motor vehicles, having a drive unit for pistons that reciprocate within cylinder bores, the pistons being driven via an adjusting plate, such as a swivel plate, swivel ring or swash plate, having an adjustable pivoting angle, and the position of the pivoting angle being influenced, inter alia, by pressure forces, inertia forces and spring forces that act in the drive unit; in accordance with the present invention, the spring forces which act on the angular pivot position of the adjusting plate being provided by a spring having a higher spring stiffness and by a counterspring having a lower low spring stiffness. A machine is preferred where the spring having the higher stiffness acts in the pivoting angle-increasing direction, and the counterspring having the lower spring stiffness acts in the pivoting angle-decreasing direction.

The advantage of this spring design is that a discontinuity in the characteristic curve of the force-pivoting angle is made possible by this combination of springs having different characteristics. By properly selecting a spring, as well as a counterspring having a substantially deviating, softer characteristic, a discontinuous characteristic curve of the spring-force quantities may be obtained over the stroke of the mechanism, thereby preventing the formation of harmonic vibrations through suppression of the bottom arc of vibration. This has the advantageous result that, in the switched-off operation of the air-conditioning system, the machine is not prone to harmonic vibrations of the pivoting mechanism about its neutral position and, when there is a demand for cooling power, thus when the air-conditioning system is switched on, it starts reliably in response to a control valve signal.

One preferred specific embodiment of the air-conditioning compressor has the distinguishing feature that the stiffer spring exhibits a limited stroke due to a maximum-stroke limit stop, while, if indicated, the weaker counterspring is active over the entire pivoting-angle stroke. An air-conditioning compressor is also preferred where the stiffer spring, at the maximum-stroke limit stop, sets the start position of the pivoting angle of the adjusting plate given a switched-off combustion engine and switched-off air-conditioning system. Here, the advantage is derived that the angular pivot position required for reliably starting the air-conditioning compressor may be precisely geometrically predetermined by the limit stop and that, accordingly, depending on the adjusting direction of the pivoting angle, either the substantially harder spring or the substantially softer spring may become active.

An air-conditioning compressor is also preferred where the limit stop of the stiffer spring is configured so as to be movable from a maximum stroke to a minimum stroke. An air-conditioning compressor is also preferred where the movable limit stop is constituted of a movable retaining ring and of a turned groove or an elongated slot on the drive shaft. The movable limit stop has the advantage of allowing the stiffer spring to only be compressed to a certain minimum stroke, thereby protecting it from being overloaded by further compression.

An air-conditioning compressor is also preferred where the limit stop allows the stiffer spring to only be active within a limited angular range of the adjusting plate. An air-conditioning compressor is likewise preferred where the softer counterspring is active over the entire angular range of the adjusting plate. Since the softer counterspring, which works against the stiffer spring, is virtually ineffective against the stiffer spring during operation due to its relatively weak design, the stiffer spring assumes the actual spring force control over the pivoting angle in the minimum pivoting-angle range. Thus, the softer counterspring may be active over the entire angular range without influencing the action of force of the stiffer spring. In principle, however, at or above the range of action of the stiffer spring, the softer counterspring may also be at the end of its spring stroke and no longer expand.

In addition, an air-conditioning compressor is preferred where the minimum pivoting angle of the adjusting plate is greater, equal to or smaller than zero degrees. An air-conditioning compressor is also preferred where the start-position pivoting angle of the adjusting plate is greater than the minimum pivoting angle.

An air-conditioning compressor according to the present invention has the distinguishing feature that, during switched-on air-conditioning operation, the stiffer spring is only active in the high-speed range of the air-conditioning compressor. In switched-off air-conditioning operation, the stiffer spring is active over the entire speed range.

BRIEF DESCRIPTION OF THE DRAWINGS

In addition, an air-conditioning compressor is preferred where the softer counterspring is active in all speed ranges of the air-conditioning compressor.

The present invention is described with reference to the figures, which show.

DETAILED DESCRIPTION

Figure 1:
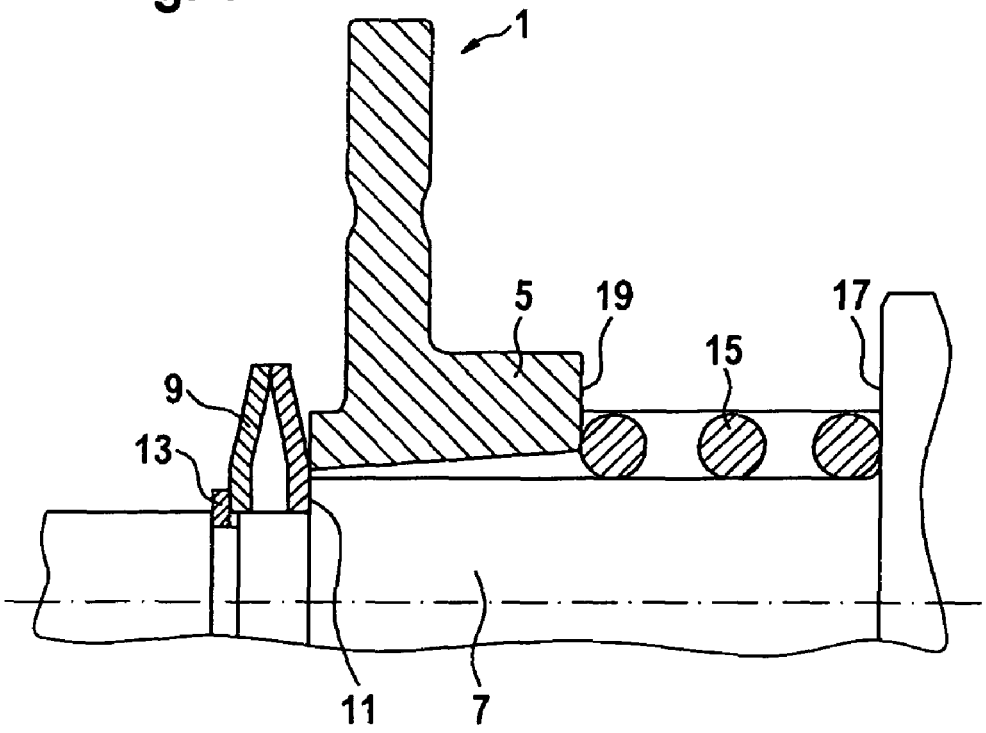
FIG. 1 a swivel plate, which strikes directly against a soft and a hard spring.

A swivel plate 1 is illustrated in FIG. 1, swivel plate 1 being pivotably and displaceably guided on the shaft by a guide sleeve 5. Not shown here is the swivel joint known from the related art that is also connected to the shaft. A stiff spring 9, which is constituted of two disk springs disposed in mutual opposition, is positioned on one side by a step 11 on shaft 7 against a maximum-stroke limit stop and, on the other side, by a retaining ring 13 on shaft 7. A helical spring 15, whose spring stiffness is considerably softer than that of double disk spring 9, strikes by its one end against a limit stop 17 of shaft 7 and by its other end against a limit stop 19 of guide sleeve 5. Thus, in the switched-off state of the air-conditioning compressor and of the combustion engine of a motor vehicle, softer spring 15 presses guide sleeve 5 against harder spring 9, which, however, without executing a spring stroke, thus sets the starting angle of swivel plate 1.

As soon as the combustion engine is started and the air-conditioning system is switched on, the starting angle of swivel plate 1 of the air-conditioning compressor induces a pressure build-up in the compressor and in the air-conditioning system, causing swivel plate 1 to swing out further and resulting in a higher mass flow rate in the air-conditioning system, the size of the pivoting angle being set by a suitable control valve that regulates the pressure in the drive chamber. Thus, the position of guide sleeve 5 of swivel plate 1 is predetermined by the influence of stiff spring 9 that remains at the limit stop, by the pressure conditions prevailing in the air-conditioning compressor, the settings specified by the control valve and by the force of softer spring 15.

At higher engine speeds, thus when the mass flow released is automatically greater due to the higher speed of the air-conditioning compressor, the pivoting angle may be correspondingly reduced, and, accordingly, guide sleeve 5 of swivel plate 1 of the air-conditioning compressor moves back in response to the expansion of softer spring 15 and to the pressure conditions set by the control valve until it again reaches the limit stop of harder spring 9. At this point, in response to a further change in the pressure conditions in the drive unit, it is necessary to first overcome the biasing force of spring 9, so that a step in the force-spring characteristic curve up to the biasing force of spring 9 is derived, before at an even higher speed of the combustion engine, guide sleeve 5 is able to reduce the pivoting angle of swivel plate 1 against hard spring 9 that is compressed at this point. In response to a further increase in the combustion engine speed, spring 9 is compressed in the extreme case to a minimum stroke against limit stop 13, and the minimum pivoting angle of the air-conditioning compressor ensues, which is thus smaller than the starting angle of the air-conditioning compressor, as described at the outset.

The minimum pivoting angle of the air-conditioning compressor is adjusted, as described at the outset, particularly in the switched-off state of the air-conditioning system, thus when no mass flow of the compressor is required, but the speed of the combustion engine is very high, for example during high-speed travel.

Figure 2:
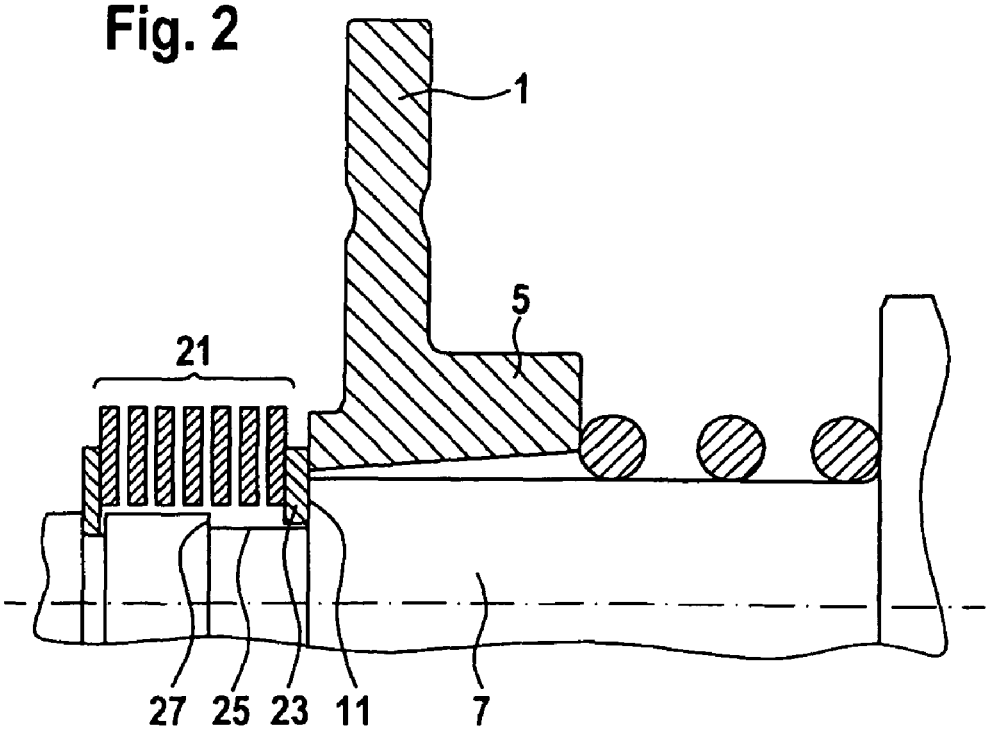
FIG. 2 the swivel plate of FIG. 1, the stiff spring having a movable maximum-stroke limit stop.

In FIG. 2, disk spring 9 of FIG. 1 is replaced by a spring assembly 21 which, with the assistance of a movable retaining ring 23 that is guided in an elongated slot 25 of the shaft, provides a movable limit stop for guide sleeve 5. Thus, at high speeds of the combustion engine, retaining ring 23 may be maximally displaced to a second limit stop 27. It ensures that spring assembly 21 is not able to be compressed further, thereby protecting the same from being overloaded. As illustrated in FIG. 1, all other components are unchanged in their function, so that reference may therefore be made to the description in FIG. 1.

Figure 3:
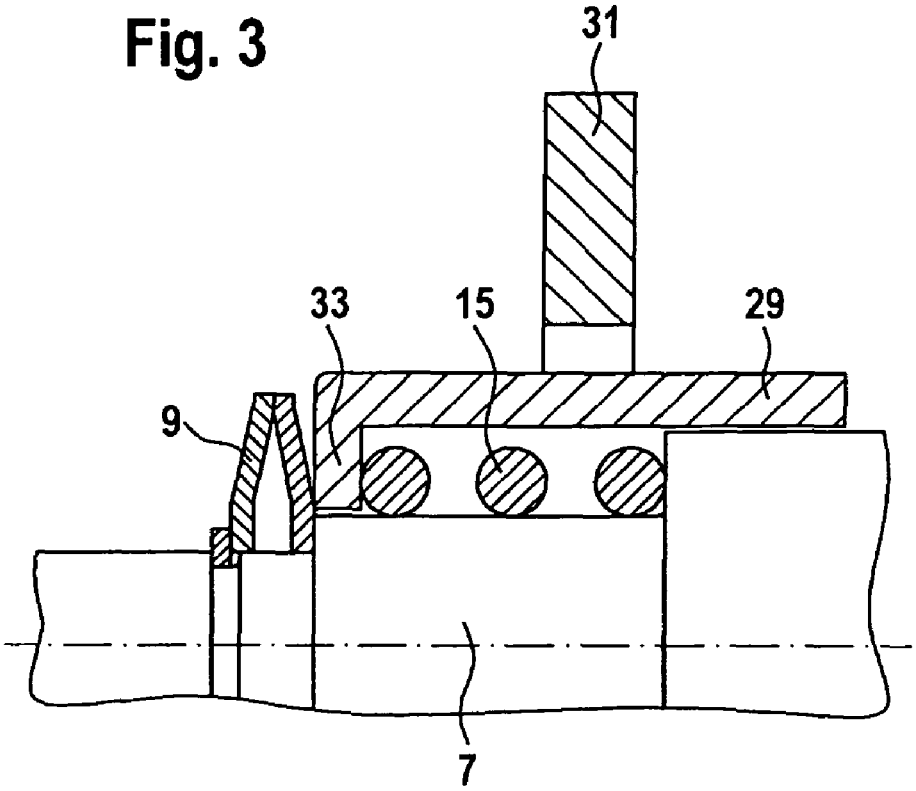
FIG. 3 a guide device for a swivel ring having a guide sleeve on the shaft and, apart from that, the spring configurations from FIG. 1.

In FIG. 3, swivel plate 1 of FIGS. 1 and 2 is replaced by a swivel ring 31 which is configured on a guide sleeve 29. Here as well, corresponding swivel joints and drivers are not shown for the sake of simplifying the description of the spring force functions. Thus, guide sleeve 29 embraces softer spring 15. This design permits a better spatial utilization of spring 15 within guide sleeve 29 since the linear dimension of guide sleeve 5 from FIGS. 1 and 2 may be greatly reduced by the relatively narrow wall 33 of the end face of guide sleeve 29. Apart from that, the function of the guide device, which is clamped between stiff spring 9 and soft spring 15, as described in FIG. 1, is also realized here.

Figure 4:
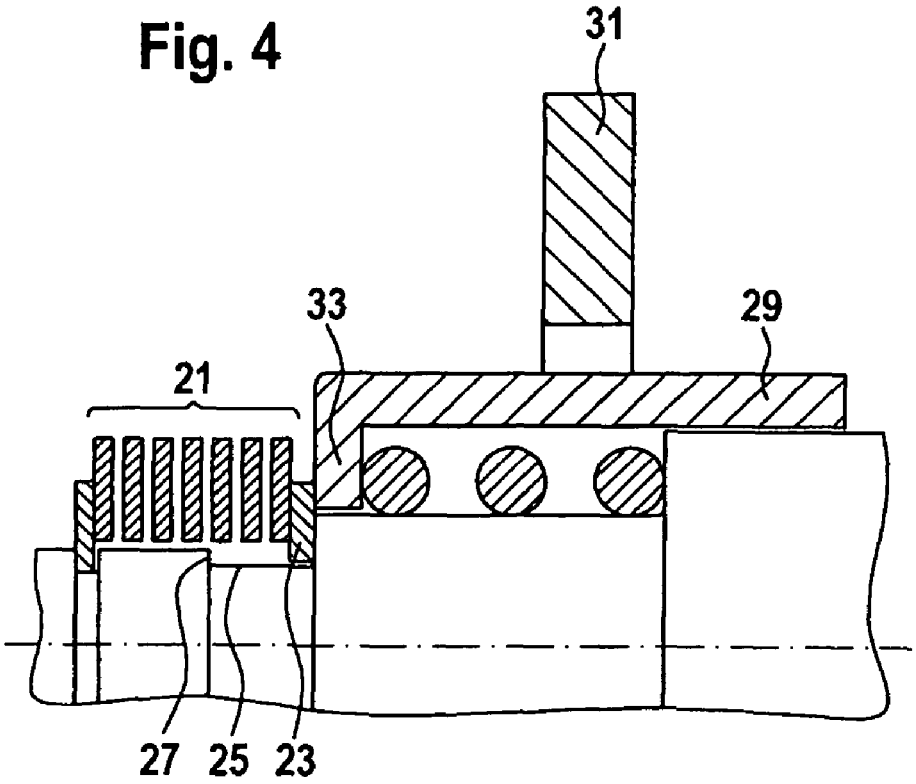
FIG. 4 a guide device for a swivel ring having a guide sleeve, as in FIG. 3, however, including a movable limit stop for the soft spring, as in FIG. 2.

In FIG. 4, the guide sleeve configuration from FIG. 3 is realized, including spring assembly 21 from FIG. 2 and the limit stop formed by movable retaining ring 23, so that, in this regard, reference may also be made to the function as described in FIG. 2.

Figure 5:
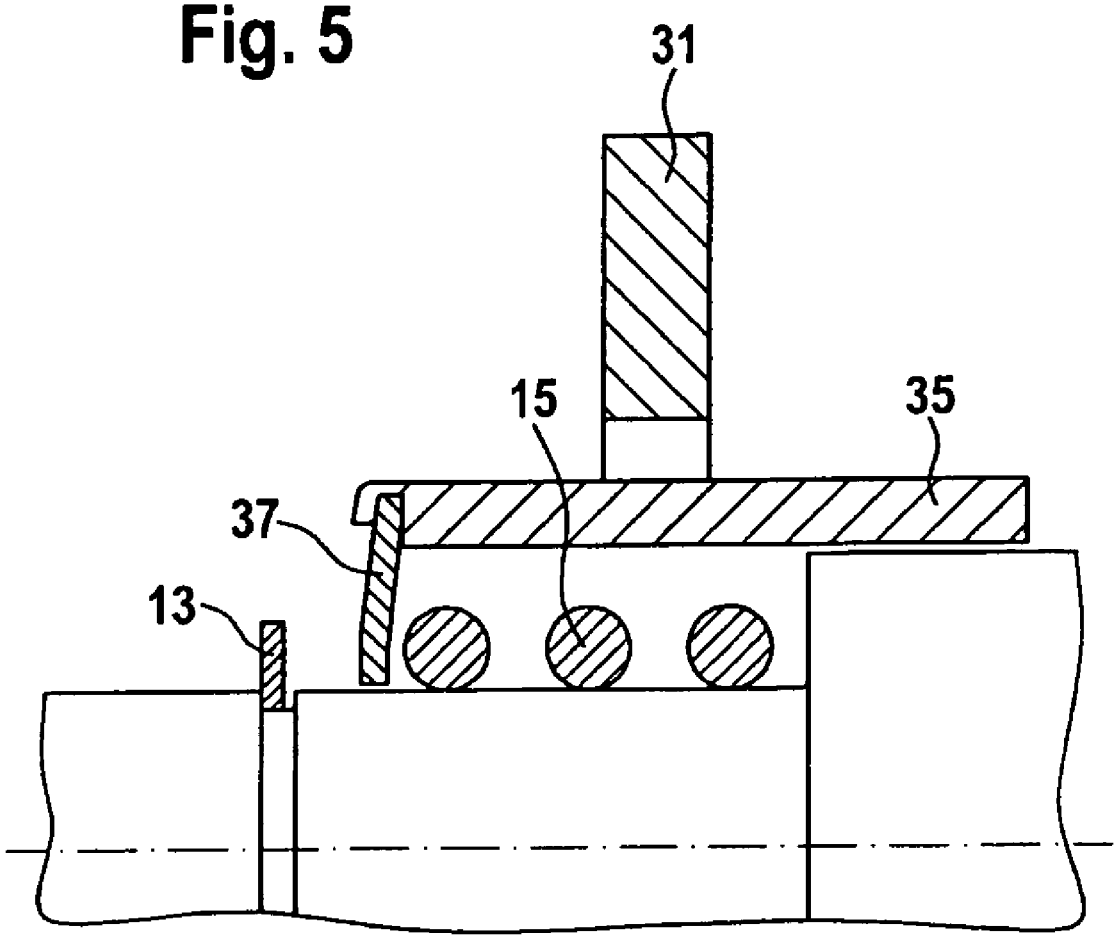
FIG. 5 a guide sleeve having a stiff disk spring on the guide sleeve and a soft counterspring within the guide sleeve.

In FIG. 5, a spring configuration is shown that differs functionally from the representations in FIG. 1 through 4. Swivel ring 31 is configured on a guide sleeve 35 which contains a disk spring 37 that is movable along with guide sleeve 35. The function of this spring combination is manifested in that, at a low combustion engine speed and a high demand for mass flow, thus, given a large pivoting angle of swivel ring 31 of the air-conditioning compressor, guide sleeve 35 compresses helical spring 15 with the assistance of stiff spring 37 and thus renders possible large pivoting angles. In response to an increase in the combustion engine speed, which leads, in turn, to an increase in the air-conditioning compressor mass flow rate, the pivoting angle of swivel ring 31 is reduced by the corresponding pressure settings of the control valve for the drive unit, so that, in addition, in response to the relieving of spring 15, the guide sleeve having stiffer spring 37 moves to the left and reduces the pivoting angle in the compressor. When stiffer spring 37 strikes against retaining ring 13, deformation of spring 37 causes an increase in the spring force in the direction of minimum pivoting angles. Thus, stiff spring 37 does not have any biasing force since soft spring 15 is ineffective against stiff spring 37. Apart from that, the functions are comparable to those described at the outset.

Figure 6:
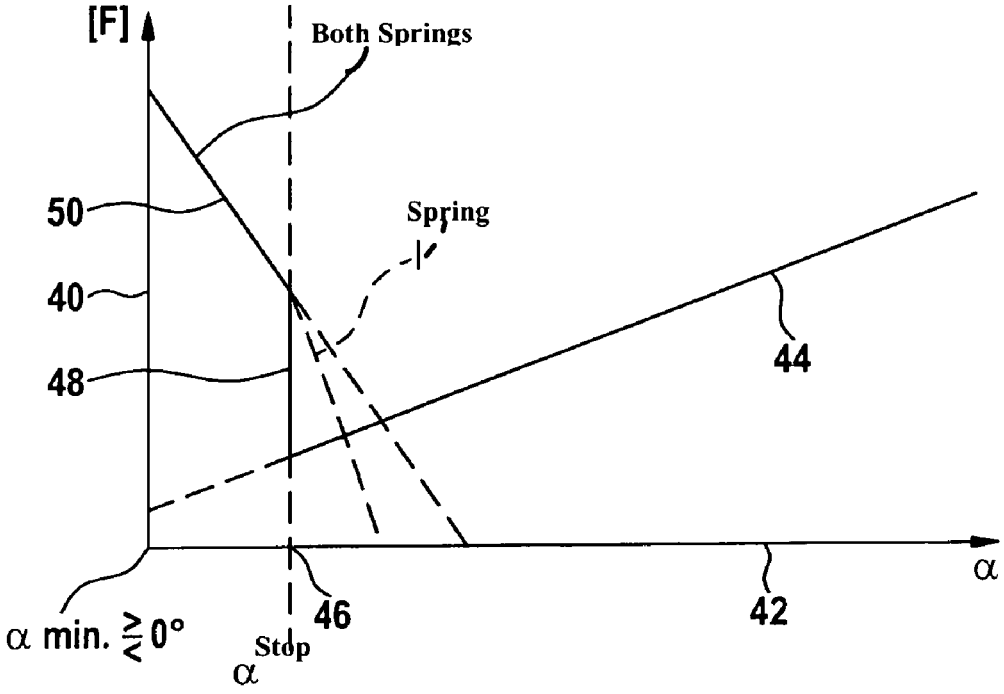
FIG. 6 the force characteristic over the pivoting angle for the machine variants from FIG. 1 through 4.

The resulting spring-force characteristic curve for the variants from FIG. 1 through 4 is schematically shown in FIG. 6. The absolute force characteristic curve of spring forces F is represented on axis 40 over pivoting angle $\alpha$ on axis 42. At a low speed and a high demand for mass flow, pivoting angle $\alpha$ increases in accordance with characteristic 44 which is set by the spring stiffness of spring 15. In response to a reduction in the pivoting angle up to limit stop point 46, which also corresponds to the starting angle in the case of a switched-off combustion engine and a switched-off air-conditioning system, the adjusting device, constituted of swivel plate 1, respectively swivel ring 31 and guide sleeves 5, 29 thereof, are driven by the limit stop against hard springs 9, 21 and the biasing force thereof, so that a force step change 48 results in the spring characteristic before hard springs 9, 21 are able to be compressed, and thus a spring-force characteristic curve is continued in accordance with characteristic curve 50. Provided that soft spring 15 is still able to take part in the biasing stroke of hard springs 9, 21, the theoretical result is an addition of the two spring-force characteristic curves, respectively a subtraction due to the decreasing spring force of spring 15 and the increasing spring force of springs 9, 21. In reality, however, spring 15 has such a softer stiffness that its force influence is negligible in the case of an increase in the spring force of spring 9.

Figure 7:
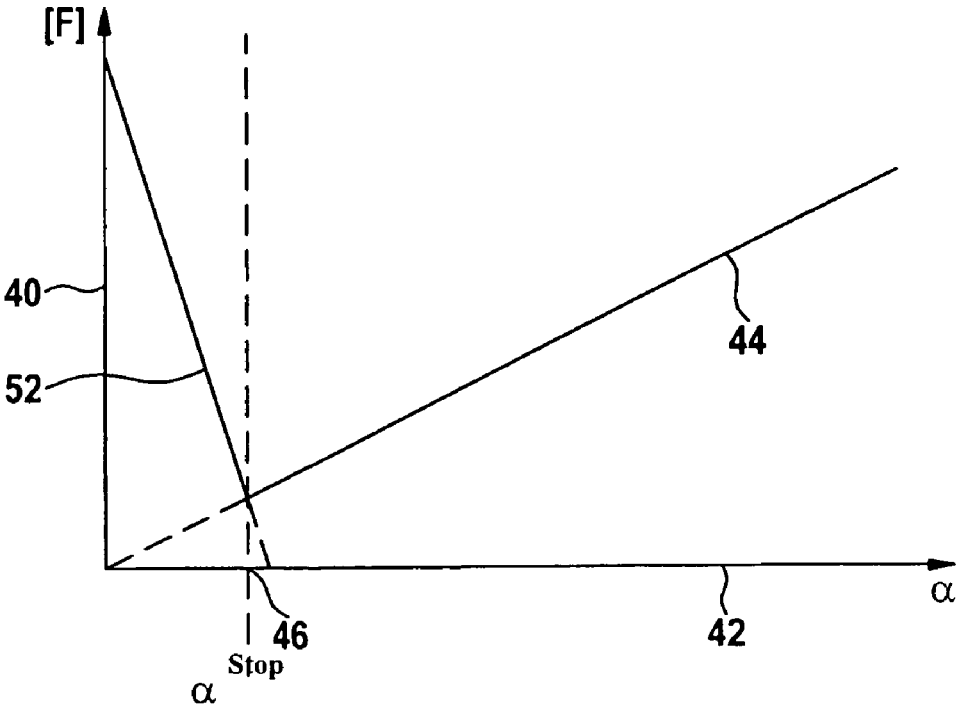
FIG. 7 the force characteristic for the machine variant from FIG. 5.

FIG. 7 illustrates the spring-force characteristic curve of the spring combinations for the design from FIG. 5. The absolute spring-force characteristic curve is represented on axis 40 over pivoting angle α on axis 42. The starting angle α-limit stop is represented, in turn, at point 46 on axis 42. At a low speed and a high demand for mass flow, the spring force of the soft spring becomes active in accordance with characteristic curve 44. However, in response to a reduction in the pivoting angle as the result of increasing combustion engine speed, as already described in FIG. 5, hard spring 37, which is not in the biased state, but rather is carried along in a untensioned state within guide sleeve 35, will deform at limit stop 13 in accordance with characteristic curve 52 and consequently execute a steep rise in spring force in the direction of small pivoting angles up to minimum limit stop α-min, which prevails, for example, at a maximum combustion engine speed and given a switched-off air-conditioning system, thus when no mass flow is required.

Thus, as a result of the variants in accordance with the present invention of this special spring-force coordination of the drive unit described at the outset, inter alia, for stabilizing the drive unit in the off-mode, the air-conditioning compressor, in the switched-off air-conditioning system operation, does not tend to induce harmonic vibrations of the pivoting mechanism about its neutral position; and, when it comes to the demand for cooling power, the control valve being able to reliably run up the system to deliver the flow rate for the air-conditioning compressor. This is achieved in accordance with the present invention by a discontinuity in the characteristic curve of the force-pivoting angle that results when springs having different characteristics are combined. By properly selecting a spring, as well as a counterspring having substantially deviating, hard and very soft characteristics, a discontinuous characteristic curve of the spring-force quantities over the stroke of the pivoting mechanism is obtained, thereby preventing harmonic vibrations through suppression of the bottom arc of vibration.

LIST OF REFERENCE NUMERALS

1 swivel plate
5 guide sleeve
7 shaft
9 hard spring
11 step
13 retaining ring
15 soft helical spring
17 limit stop
19 limit stop
21 hard spring assembly
23 retaining ring
25 elongated slot
27 limit stop
29 guide sleeve
31 swivel ring
33 wall of the end face
35 guide sleeve
37 hard disk spring
40 axis spring-force characteristic curve
42 axis pivoting-angle characteristic curve
44 soft spring characteristic
46 limit stop point
48 force step change
50 hard spring characteristic
52 hard spring characteristic

The invention claimed is:

1. A variable-displacement air-conditioning compressor for motor vehicles comprising:

a drive unit for pistons that reciprocate within cylinder bores, the pistons being driven via an adjusting plate having an adjustable pivoting angle, and the position of the pivoting angle being influenced by pressure forces, inertia forces, and spring forces acting in the drive unit;

wherein the spring forces acting on the position of the pivoting angle of the adjusting plate are produced by a spring having a higher spring stiffness and by a counterspring having a lower spring stiffness;

wherein the spring acts in the pivoting angle-increasing direction, and the counterspring acts in the pivoting angle-decreasing direction;

wherein the spring exhibits a limited stroke due to a limit stop while the counterspring is active over the entire stroke of the adjusting plate; and wherein the limit stop of the spring is movable between a maximum-stroke position and a minimum-stroke position.

2. The air-conditioning compressor as recited in claim 1 wherein, at the maximum-stroke position of the limit stop, the spring sets a start position of the pivoting angle of the adjusting plate when a combustion engine is switched-off and an air conditioning system is switched-off.

3. The air-conditioning compressor as recited in claim 1 wherein the movable limit stop includes a movable retaining ring and a turned groove or an elongated slot on a drive shaft.

4. The air-conditioning compressor as recited in claim 1 wherein the limit stop allows the spring to only be active within a limited angular range of the adjusting plate.

5. The air-conditioning compressor as recited in claim 1 wherein the counterspring is active in the entire angular range of the adjusting plate.

6. The air-conditioning compressor as recited in claim 1 wherein a minimum pivoting angle of the adjusting plate is greater than zero degrees.

7. The air-conditioning compressor as recited in claim 2 wherein the start-position of the pivoting angle of the adjusting plate is greater than a minimum pivoting angle.

8. The air-conditioning compressor as recited in claim 1 wherein, when an air conditioning system is switched-on, the spring is only active in a high-speed range of the air-conditioning compressor and, when the air conditioning system is switched-off, the spring is active over an entire speed range.

9. The air-conditioning compressor as recited in claim 1 wherein the counterspring is active in all speed ranges of the air-conditioning compressor.

10. The air conditioning compressor as recited in claim 1 wherein the adjusting plate is one of a swivel plate, a swivel ring or a swash plate.

11. The air-conditioning compressor as recited in claim 1 wherein a minimum pivoting angle of the adjusting plate is equal to zero degrees.

12. The air-conditioning compressor as recited in claim 1 wherein a minimum pivoting angle of the adjusting plate is smaller than zero degrees.

* * * * *